US005134874A

United States Patent [19]

Williams

[11] Patent Number: 5,134,874

[45] Date of Patent: * Aug. 4, 1992

[54] METHOD FOR PERFORMING WORK

[75] Inventor: Warren R. Williams, Fort Collins, Colo.

[73] Assignee: Coors Brewing Company, Golden, Colo.

[ * ] Notice: The portion of the term of this patent subsequent to Sep. 18, 2007 has been disclaimed.

[21] Appl. No.: 756,906

[22] Filed: Sep. 9, 1991

Related U.S. Application Data

[60] Division of Ser. No. 499,773, Mar. 27, 1990, Pat. No. 5,046,374, which is a continuation of Ser. No. 402,608, Sep. 5, 1989, Pat. No. 4,956,990.

[51] Int. Cl.[5] ..... B21J 9/18

[52] U.S. Cl. ..... 72/449

[58] Field of Search ..... 72/347, 349, 417, 449; 74/44, 55, 568, 569 R

[56] References Cited

U.S. PATENT DOCUMENTS

| | | |
|---|---|---|
| 130,758 | 8/1872 | Samers . |
| 1,023,685 | 4/1912 | Ruwell . |
| 1,236,863 | 8/1917 | Oiler . |
| 1,464,824 | 8/1923 | Kollock et al. . |
| 1,910,534 | 3/1933 | Glasner . |
| 3,696,657 | 10/1972 | Maytag . |
| 3,964,322 | 6/1976 | Kieper . |
| 4,132,118 | 1/1979 | Harr . |
| 4,173,138 | 11/1979 | Main et al. . |
| 4,530,228 | 7/1985 | Snyder et al. . |
| 4,590,812 | 5/1986 | Brackett . |
| 4,607,517 | 8/1986 | Finzer et al. . |
| 4,915,565 | 4/1990 | Bond et al. . |
| 4,956,990 | 9/1990 | Williams . |

FOREIGN PATENT DOCUMENTS 645182 1/1979 U.S.S.R. .

OTHER PUBLICATIONS

Ingenious Mechanisms (The Industrial Press), 1951.

*Primary Examiner*—Lowell A. Larson

*Attorney, Agent, or Firm*—Klaas, Law, O'Meara & Malkin

[57] ABSTRACT

Apparatus for forming can blanks into elongated can bodies comprising a support structure having first and second gears rotatably mounted on the support structure and drive means for rotating the first and second gears so that the second gear rotates in a direction opposite to the direction of rotation of the first gear. A redraw assembly and can forming and ironing dies located adjacent to the support structure. A ram mounted on the support structure for reciprocating linear movement with portions thereof passing through the redraw assembly and the can forming and ironing dies. Connecting the ram to the first and second gears so that rotation of the first and second gears reciprocates the ram. In one embodiment, the ram does not rotate during the reciprocation thereof but in another embodiment the ram rotates during the reciprocation thereof.

2 Claims, 7 Drawing Sheets

METHOD FOR PERFORMING WORK

This application is a Divisional Application of U.S. Ser. No. 499,773 filed Mar. 27, 1990 now U.S. Pat. No. 5,046,374, which is a continuation application of U.S. Ser. No. 402,608 filed Sept. 5, 1989, now U.S. Pat. No. 4,956,990.

FIELD OF THE INVENTION

This invention relates generally to apparatus for forming can blanks into elongated can bodies and more specifically to apparatus for reciprocating a ram of a can body making apparatus through a redraw assembly and can forming and ironing dies.

BACKGROUND OF THE INVENTION

In can body making apparatus of the type illustrated in U.S. Pat. Nos. 3,696,657 to Maytag; 4,173,138 to Main et al.; and 4,530,228 to Snyder, the main power source for reciprocating the ram is a rotary motion that uses crank arms of some nature to convert the rotary motion to a linear motion so as to reciprocate the ram. This form of motion results in high linear inertial loads that must be compensated for by the machine frame and the machine foundation. Also, these high inertial loads place an upper limit on the speed of the body maker. These patents recognize that this type of rotary to linear movement conversion places forces on the ram that act in directions other than that which is most desirable and provide apparatus to compensate for them. Thus, there exists a need to provide apparatus for reciprocating a ram in a body making apparatus wherein the inertial loads on the machine frame and foundation are held to a minimum and wherein the forces applied to reciprocate the ram extend in the axial direction of reciprocation.

BRIEF DESCRIPTION OF THE INVENTION

This application provides apparatus for reciprocating a ram in a can body making apparatus wherein rotary motion is converted into linear motion with a minimum of inertial loads being placed on the machine frame and foundation and the forces applied to reciprocate the ram extend substantially in the axial directions of reciprocation. The nature of the apparatus is also such that the apparatus requires less factory floor space for the same can body making capability as is now considered standard, or such that the apparatus has more can body producing capability for the amount of factory floor space now considered standard.

In one preferred embodiment of the invention, the apparatus for forming a can blank into an elongated can body comprises support structure, such as a housing, having a bottom portion, a front portion, a back portion, a top portion and first and second side portions which support structure is mounted at a fixed location. A driving gear is rotatably mounted on the front portion and within the support structure and is rotated by a driving shaft which is rotated by conventional means such as a clutch/flywheel assembly which in turn is rotated by belts driven by a motor. A first driven gear is rotatably mounted on the top portion for rotation about an axis and is in mesh with the driving gear. A second driven gear is rotatably mounted on the bottom portion for rotation about an axis that is aligned with the axis of rotation of the first driven gear and is in mesh with the driving gear. This arrangement produces counter rotation between the first and second driven gears. A third driven gear is rotatably mounted on the back portion of the support structure for rotation about an axis that is aligned with the axis of rotation of the driving gear and is in mesh with both the first and second driven gears. If desired, a shaft may be connected to the third driven gear to be rotated thereby and provide a source of power for other operations.

A first redraw sleeve assembly has a pair of push rods extending outwardly therefrom which push rods are slidably mounted in the first side portion and cooperate with actuating means to reciprocate the first redraw sleeve assembly. A first can forming and ironing die means are supported at a fixed location for cooperating with the redraw sleeve assembly in forming can blanks into elongated can bodies. The first redraw sleeve assembly is located between the first side portion and the first can forming and ironing die means. A ram is slidably mounted in the support structures with portions thereof moving through the first side portion, the first redraw assembly and the first can forming and ironing dies means to form can blanks into elongated can bodies. Connecting means connect the ram to the first and second driven gears so that rotation of the first and second driven gears reciprocates the ram in the linear directions.

A second redraw assembly has a pair of support shafts extending outwardly therefrom which shafts are slidably mounted in the second side portion and cooperate with actuating means to reciprocate the second redraw assembly. A second can forming and ironing die means are supported at a fixed location for cooperating with the second redraw assembly in forming can blanks into elongated ca bodies. The second redraw assembly is located between the second side portion and the second can forming and ironing die means. Other portions of the ram move through the second side portion, the second redraw assembly and the second can forming and ironing die means to form can blanks into elongated can bodies.

The connecting means for connecting the ram to the first and second driven gears comprises a bearing having relatively rotatable inner and outer members mounted on the ram by securing the inner member to the ram. First connecting means are provided for connecting the first driven gear and the outer member wherein a first end portion thereof is fixedly connected to the outer member. First mounting means are provided for mounting a second end portion of the first connecting means on the first driven gear so that the second end portion may rotate and slide relative to said first driven gear. Second connecting means are provided for connecting the second driven gear and the outer member wherein a first end portion thereof is fixedly connected to the outer member. Second mounting means are provided for mounting a second end portion of the second connecting means on the second driven gear so that the second end portion may rotate and slide relative to the second driven gear. Rotation preventing means are provided for preventing rotation of the ram during the reciprocation thereof. In the foregoing relationship, rotation of the first and second driven gears will produce linear reciprocation of the ram with the forces applied to the ram through the bearing mounted thereon extending in the direction of reciprocation. Also, the counter rotation of the first and second driven gears balances out the inertial forces generated by each driven gear.

In another embodiment of the invention, the bearing is omitted and the first end portions of the first and second connecting means are fixedly connected to the ram so that the ram rotates as it is reciprocated.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
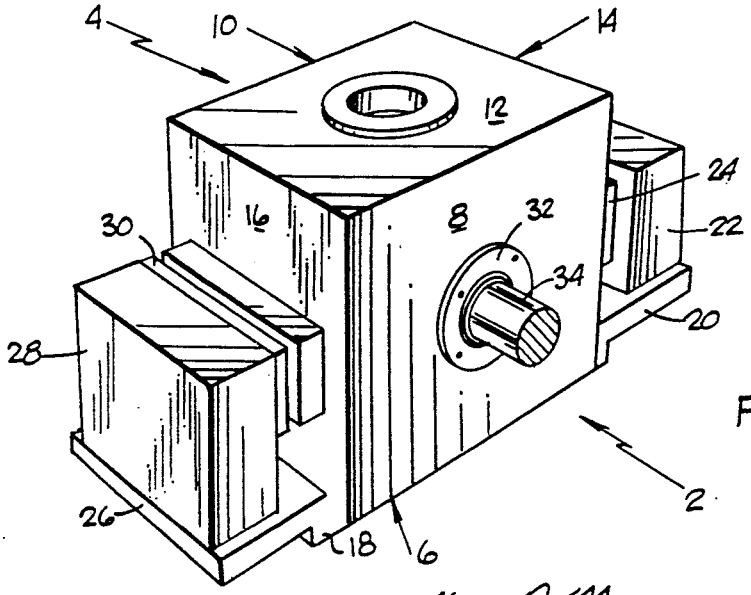
FIG. 1 is a perspective view of the apparatus of this invention.

In FIG. 1, there is illustrated a preferred embodiment of the invention and comprises a body maker 2 having a central support structure which in the illustration of FIG. 1 is a housing 4. It is understood that the central support structure can take many different types of forms and that the housing 4 is used only for illustrative purposes. The housing 4 has a bottom portion 6, a front portion 8, a back portion 10, a top portion 12, a first side portion 14 and a second side portion 16. A pair of support legs 18, FIG. 2, integral with the bottom portion 6 are used to support the body maker 2 on the factory floor (not shown). A first support ledge 20 is integral with and extends outwardly from the bottom portion 6 and supports a first can forming and ironing die means 22. A first redraw assembly 24 is located between the first can forming and ironing die means 22 and the first side portion 14. A second support ledge 26 is integral with and extends outwardly from the bottom portion 6 and supports a second can forming and ironing die means 28. A second redraw assembly 30 is located between the second can forming and ironing die means 28 and the second side portion 16. Mounting means 32 are secured to the front portion 8 and rotatably support a drive shaft 34 which is rotated by conventional means such as a clutch/flywheel assembly which in turn is rotated by belts driven by a motor 36 (FIG. 2).

Figure 2:
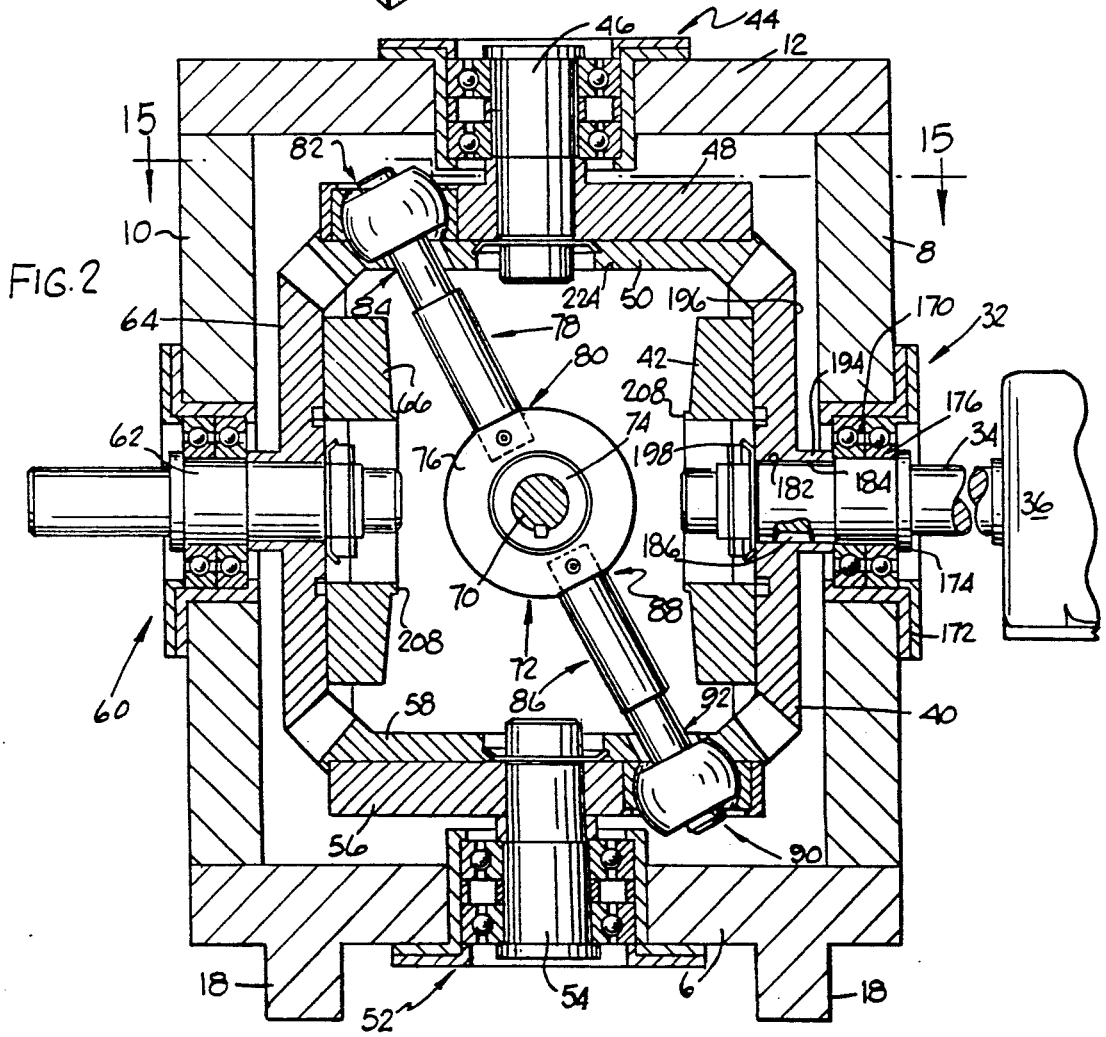
FIG. 2 is a side elevational view with parts removed and parts in section taken from the left side of FIG. 1.
Figure 15:
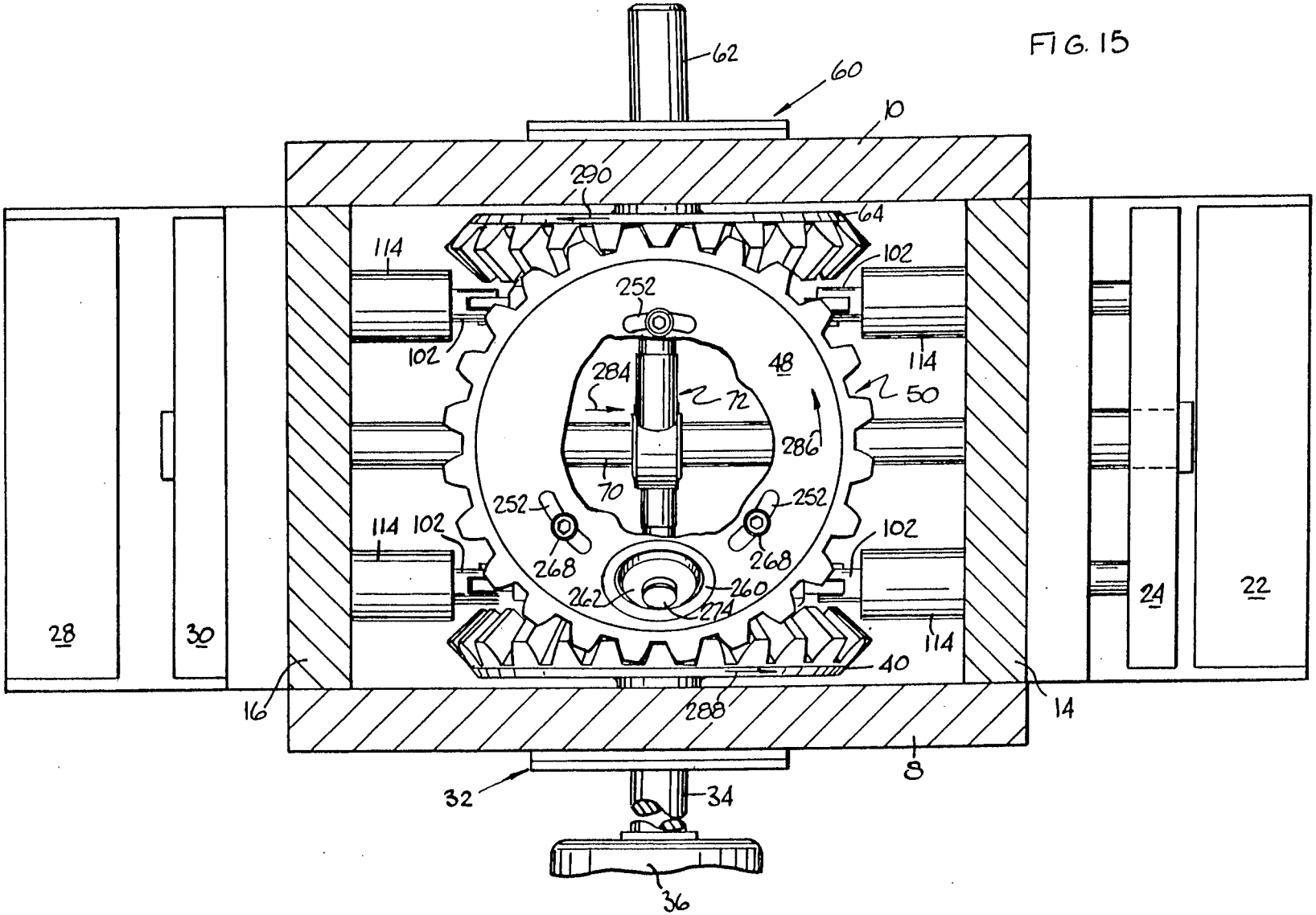
FIG. 15 is a top plan view with parts broken away.
Figure 16:
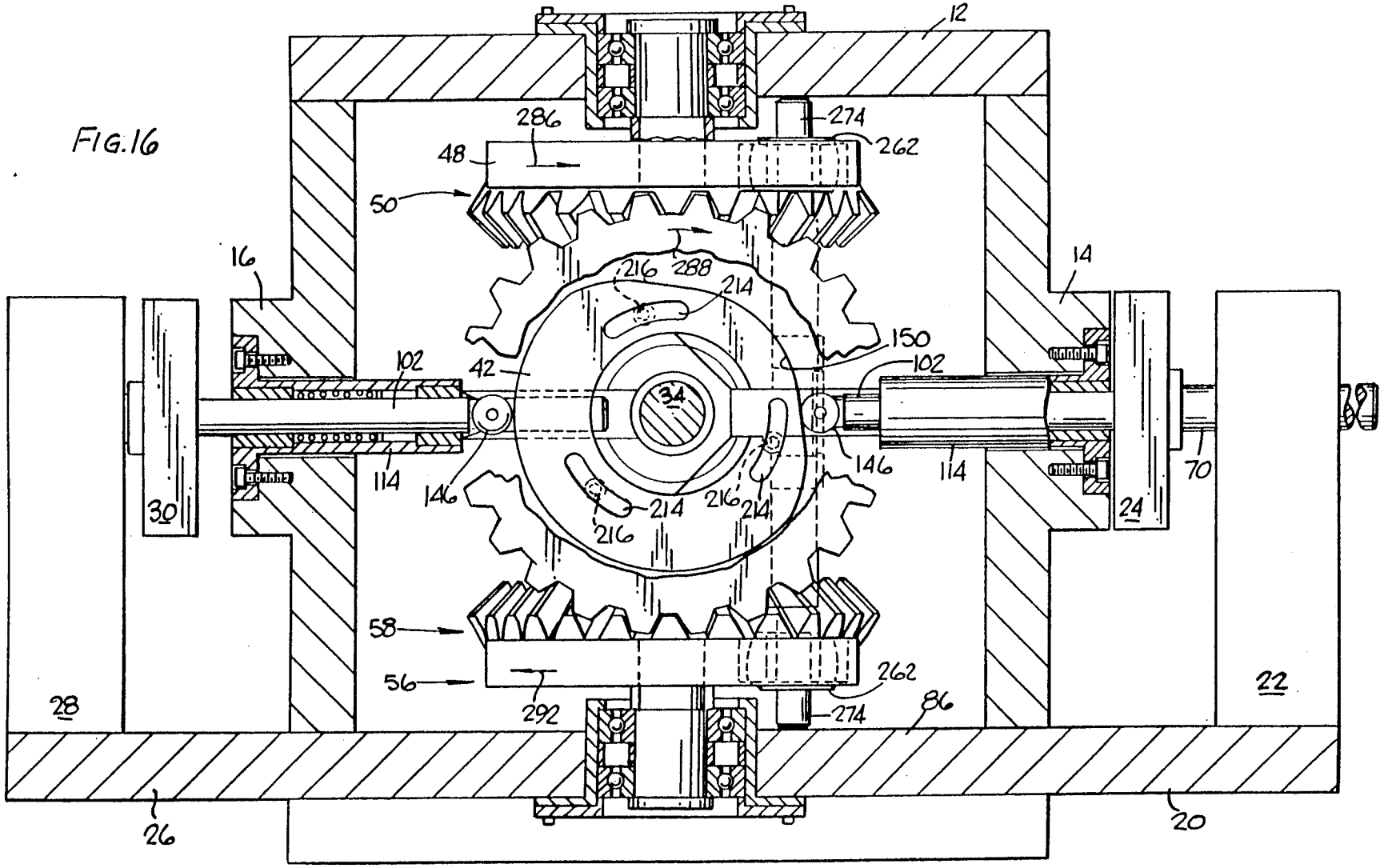
FIG. 16 is a front elevational view With parts removed and parts in section.

The apparatus inside of the housing 4 is illustrated in FIGS. 2, 15 and 16, wherein the drive shaft 34 projects inwardly from the mounting means 32. A driving gear 40 is secured to the drive shaft 34 for rotation therewith and a cam 42 is adjustably secured to the driving gear 40 for rotation therewith. Mounting means 44 are secured to the top portion 12 and rotatably support a shaft 46. A mounting member 48 is secured to the shaft 46 for rotation therewith and a first driven gear 50 is adjustably secured on the mounting member 48 for rotation therewith. The first driven gear 50 is in mesh with the driving gear 40. Mounting means 52 are secured to the bottom portion 6 and rotatably support a shaft 54. A mounting member 56, corresponding to the mounting member 48, is secured to the shaft 54 for rotation therewith and a second driven gear 58 is adjustably secured on the mounting member 56 for rotation therewith. Mounting means 60 are secured to the back portion 10 and rotatably support a shaft 62. A third driven gear 64 is secured to the shaft 62 for rotation therewith and a cam 66 is adjustably secured to the third driven gear 66 for rotation therewith. The structure described in this paragraph will be described more fully below. The axes of rotation of the driving gear 40 and the third driven gear 64 are in alignment and, when viewed from the right hand side of FIG. 2, their directions of rotation are opposite so that if the driving gear 40 rotates in a clockwise direction, the third driven gear 64 rotates in a counter-clockwise direction. Also, the axes of rotation of the first driven gear 50 and the second driven gear 58 are in alignment and, when viewed from the top side of FIG. 2, their directions of rotation are opposite so that if the first driven gear 50 rotates in a counter-clockwise direction, the second driven gear 58 rotates in a clockwise direction. It is to be understood that the terms bottom, front, back, top and first and second portions are used for description purposes only and the apparatus will function in the same manner with the aligned axes of the first and second driven gears extending in any direction. Also, if desired, the gears 50 and 58 may be directly connected to separate drive motors that are driven in synchronism. In such structure there would be no need for the gears 40 and 64.

A ram 70 is mounted for sliding movement in bushings secured in the first side portion 14 and the second side portion 16, described more fully below, so that the ram 70 may be reciprocated in one linear direction to move through the first redraw assembly 24 and the first can forming and ironing die means 22 and in the opposite linear direction to move through the second redraw assembly 30 and the second can forming and ironing die means 28 to form conventional can blanks into conventional elongated can bodies. A bearing 72, such as an angular roller bearing, is provided and has an inner member 74 secured to the ram 70 and an outer member 7 with the inner 74 and outer 76 members rotatable relative to each other. First connecting means 78 are provided for connecting the first mounting member 48 and the outer member 76 with a first end portion 80 fixedly connected to the outer member 76. First mounting means 82 are provided for mounting a second end portion 84 of the first connecting means 78 on the first mounting member 48 so that the second end portion 84 may rotate and slide relative to the first mounting member 48 and the first driven gear 50. Second connecting means 86 are provided for connecting the second mounting member 56 with the outer member 76 with a first end portion 88 fixedly connected to the outer member 76. Second mounting means 90 are provided for mounting a second end portion 92 of the second connecting means 86 on the second mounting member 56 so that the second end portion 92 may rotate and slide relative to the second mounting member 56 and the second driven gear 58.

Figure 8:
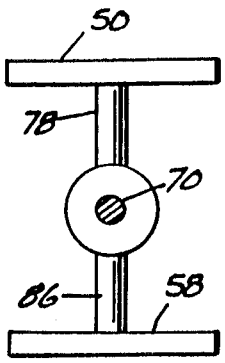
FIGS. 3–14 are schematic illustrations showing the operation of the apparatus of this invention.
Figure 7:
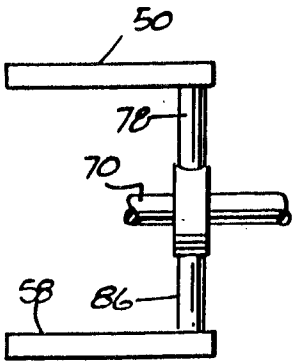
Figure 6:
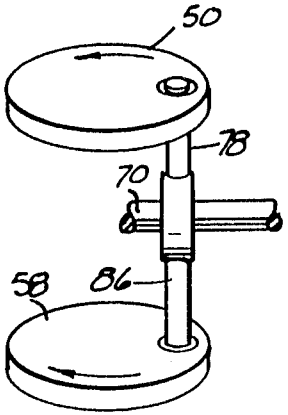
Figure 5:
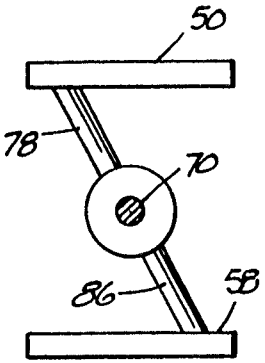
Figure 4:
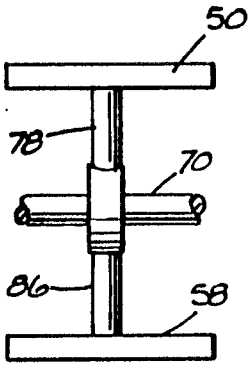
Figure 3:
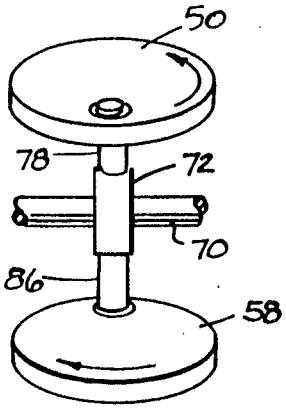
Figure 14:
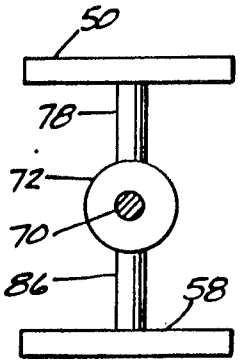
Figure 13:
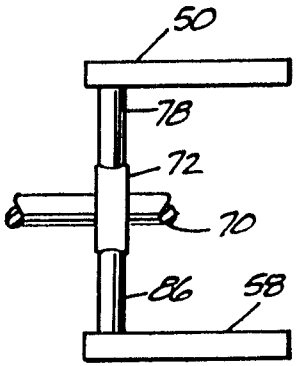
Figure 12:
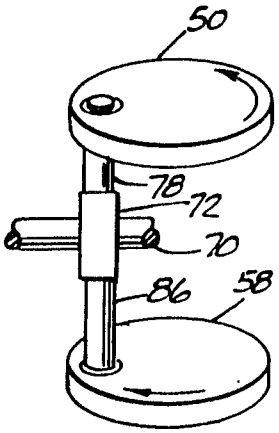
Figure 11:
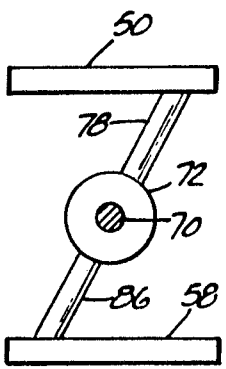
Figure 10:
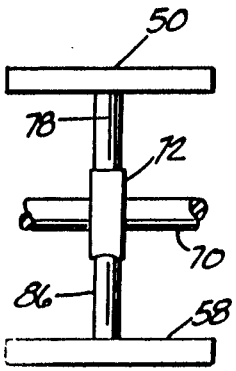
Figure 9:
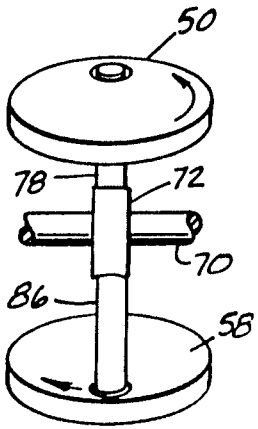

The operation of the first 50 and second 58 driven gears to provide reciprocating linear movement of the ram 70 is illustrated schematically in FIGS. 3–14. In FIGS. 3–5, the first 50 and second 58 driven gears are located so that the ram 70 is at the mid-point of its total distance of reciprocation. In FIGS. 6–8, the first driven gear 50 has rotated through 90 degrees in a counter-clockwise direction from its location in FIG. 3 and the second driven gear 58 has rotated through 90 degrees in a clockwise direction from its location in FIG. 3. The ram 70 has been moved in the direction of the arrow 94 so that one end thereof has passed through the first redraw assembly 24 and the first can forming and ironing die means 22. In FIGS. 9–11, the first 50 and second 58 driven gears have been rotated through 180 degrees and the ram 70 is again at the mid-point of its total distance of reciprocation. In FIGS. 12–14, the first driven gear 50 has rotated through 90 degrees in a counter-clockwise direction from its location in FIG. 9 and the second driven gear 58 has rotated through 90 degrees in a clockwise direction from its location in FIG. 9. The ram 70 has been moved in the direction of the arrow 96 so that the opposite end thereof has passed through the second redraw assembly 30 and the second can forming and ironing die means 28.

Figure 17:
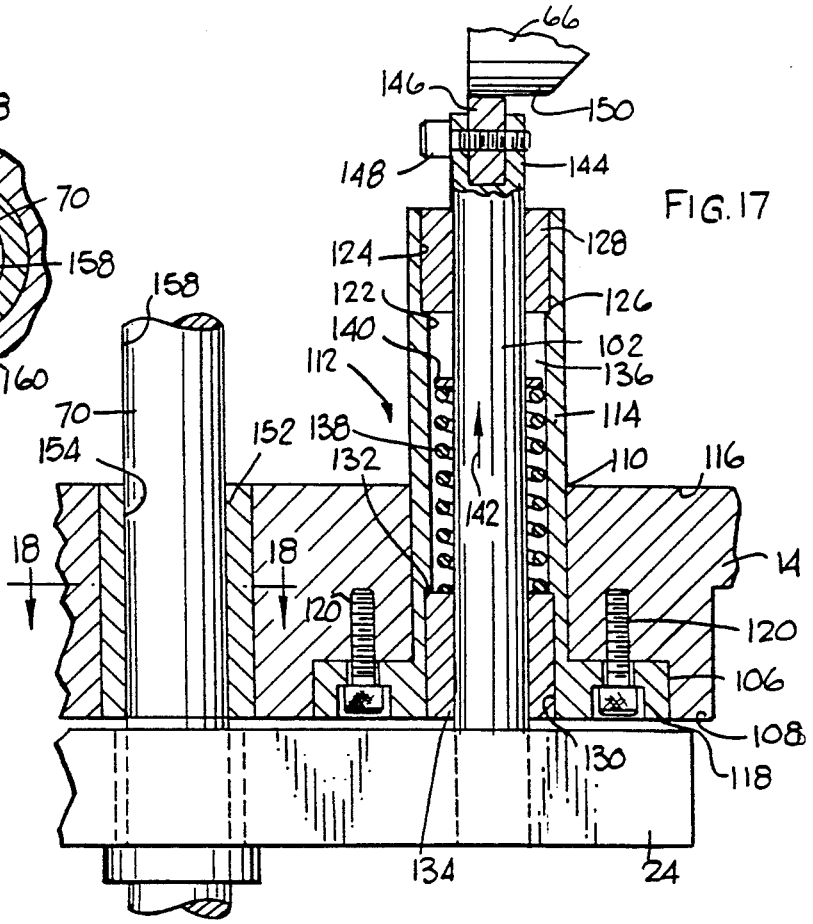
FIG. 17 is an enlarged top plan view of the actuating means for reciprocating the redraw assembly.

In FIGS. 15–17, there is illustrated the actuating means for reciprocating the first 24 and second 30 redraw assemblies. Since the actuating means are of the same construction, the actuating means will be described in relation to the first redraw assembly 24 and corresponding reference numerals will be applied to corresponding structure on the second redraw assembly 30. A pair of spaced apart push rods 102 having generally cylindrical outer surfaces project outwardly from the first redraw assembly 24 and are mounted for sliding movement in the first side portion 14. In FIG. 17, there is illustrated the mounting system for each of the shafts 102. A recess 106 is formed in the outer surface 108 of the first side portion 14 and an opening 110 extends inwardly from the recess 106. A housing 112 has a hollow portion 114 that extends through the opening 110 and projects beyond the inner surface 116 of the first side portion 14. An enlarged portion 118 of the housing 112 has a configuration corresponding to the configuration of the recess 106 and is seated therein. A plurality of threaded bolts 120 secure the housing 112 to the first side portion 14. The housing 112 has a central portion having a generally cylindrical inner surface 122 and an inner portion having a generally cylindrical inner surface 124 having a diameter greater than the diameter of the generally cylindrical inner surface 122 so as to form an annular shoulder 126. A bushing 128 is press-fitted into the generally cylindrical inner surface 124 and abuts against the annular shoulder 126. The housing 112 has an outer portion having a generally cylindrical inner surface 130 having a diameter greater than the diameter of the generally cylindrical inner surface 122 so as to form an annular shoulder 132. A bushing 134 is press-fitted into the generally cylindrical inner surface 130 and abuts against the annular shoulder 132. The generally cylindrical outer surface of the shaft 102 has a diameter less than the diameter of the generally cylindrical inner surface 122 so that an annular space 136 exists therebetween. A spring 138 surrounds the shaft 102 and is compressed between the bushing 134 and a retaining member 140 so that the spring 138 urges the shaft 102 in a direction indicated by the arrow 142. The shaft 102 has a bifurcated end portion 144 in which a cam follower 146 is rotatably mounted on a threaded bolt 148 secured in the bifurcated end portion 144. The cam follower 144 is urged into contact with the peripheral camming surface 150 of the cam 66, described more fully below.

Figure 18:
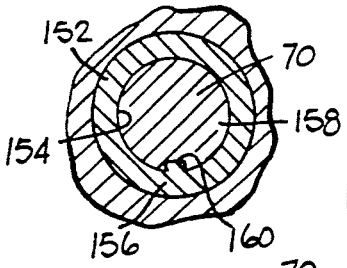
FIG. 18 is a cross-sectional view taken on the line 18—18 of FIG. 17.

The mounting of the ram 70 for sliding movement in the first side portion 14 is illustrated in FIGS. 17 and 18. A bushing 152 is fixedly mounted in the first side portion 14 and has a generally cylindrical inner surface 154 with a longitudinally extending, inwardly projecting key 156. The ram 70 has a generally cylindrical outer surface 158 for mating engagement with the generally cylindrical inner surface 154 and a longitudinally extending, inwardly projecting keyway 160 for receiving the key 156. The key 156 and the keyway 160 prevent rotation of the ram 70. The mounting of the ram 70 for sliding movement in the second side portion 16 is the same as the mounting in the first side portion 14.

The construction and mounting of the driving gear 40 and cam 42 is illustrated in in FIGS. 2 and 23–25. The outer member 170 of a bearing is secured in a two-part bearing housing 172 which is secured to the front portion 8 by suitable means such as bolts. A flange 174 on the drive shaft 34 abuts against the inner member 176 of the bearing. The driving gear 40 is a bevel gear having a central body portion 178, FIG. 23, having a generally planar surface and a central opening 180 having a longitudinal axis and a generally cylindrical inner surface 182 for mating engagement with the generally cylindrical outer surface 184 of the drive shaft 34. A key 186 on the drive shaft 34 fits into the keyway 188 so that driving gear 40 rotates with the drive shaft 34.

Figure 19:
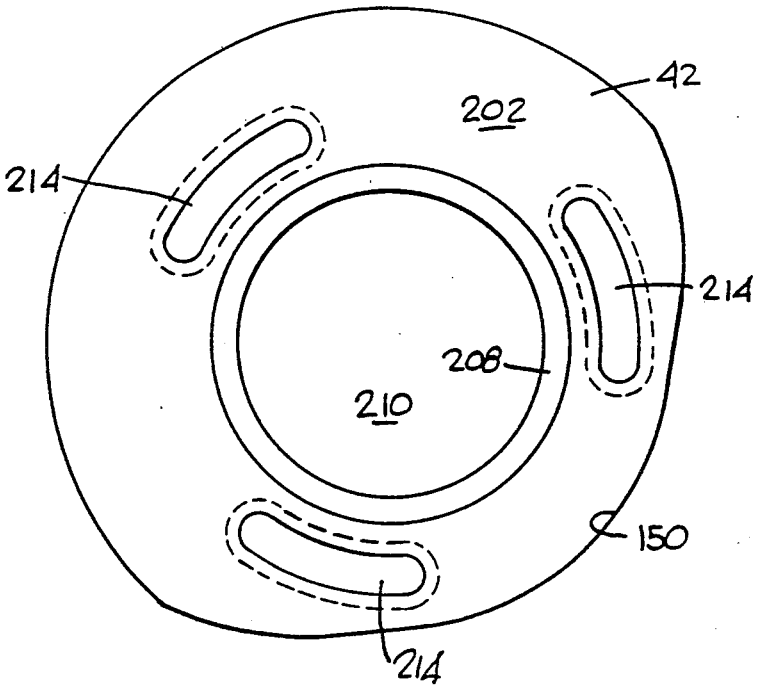
FIG. 19 is a bottom plan view of a cam for the redraw assembly actuating means.
Figure 20:
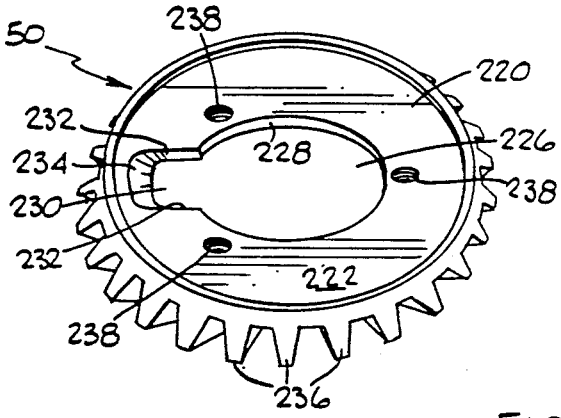
FIG. 20 is a perspective view of the first or second driven gear.
Figure 21:
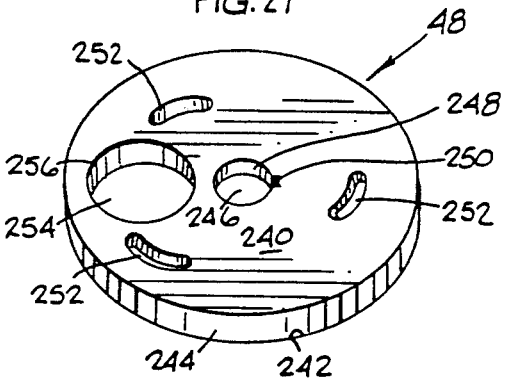
FIG. 21 is a perspective view of the mounting means for the gear of FIG. 20.
Figure 25:
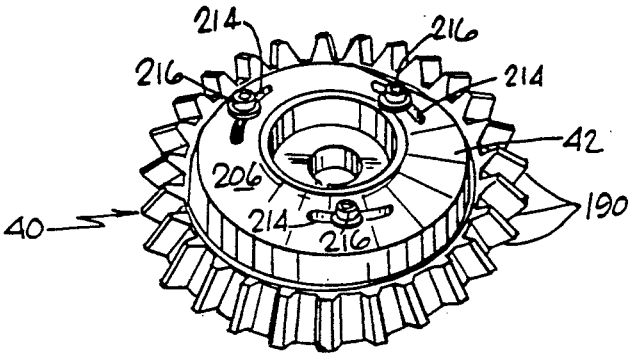
FIG. 25 is a perspective view of the FIGS. 23 and 24 in assembled relationship.

A plurality of integral teeth 190 project radially outwardly from the central body portion 178 and extend at an angle of about 45 degrees relative the longitudinal axis thereof. A plurality of spaced apart threaded openings 192 extend in an axial direction into the central body portion 178. An annular flange 194 projects axially outwardly from the outer surface 196 of the driving gear 40 and abuts against the inner member 176. Clamping means 198 clamp the driving gear onto the drive shaft 34 so that the flange 194 is against the inner member 176. The cam 42, FIGS. 19 and 24, has a generally planar bottom surface 202, a peripheral camming surface 150, a generally conical top surface 206 terminating in an annular flange 208 and a central opening 210 having a generally cylindrical inner surface 212. A plurality of spaced apart arcuately shaped slots 214 extend in an axial direction through the cam 42. As illustrated in FIG. 25, the driving gear 40 and the cam 42 are assembled by putting the bottom surface 202 of the cam 42 on the inner surface 178 and passing a headed threaded bolt 216 through each of the arcuately shaped slots 214 and threading each bolt 216 into one of the threaded openings 192 so that the cam 42 is adjustably mounted on the driving gear 40. The arcuately shaped slots 214, the bolts 216 and the threaded openings 192 are designed so that when the bolts are tightened to secure the cam 42 firmly on the driving gear 40, the axes of the central openings 180 and 210 coincide. The cam 66 is assembled onto the third driven gear 64 in the same manner and the assembled third driven gear 64 and cam 66 are mounted on the shaft 62 and rotatably mounted on the rear portion 10 in the same manner as the assembled driving gear and cam 44.

The construction and mounting of the first driven gear 50 and its related components is illustrated in FIGS. 2 and 20–22. The shaft 46 is rotatably mounted in the top portion 12 in substantially the same manner as the drive shaft 34 is mounted in the front portion 8 so that the explanation of such mounting will not be duplicated. The first driven gear 50 is a bevel gear having a central body portion 220 having a generally planar upper surface 222 and a generally planar lower surface 224. A central opening 226 extends through the central body portion 220 and has a generally cylindrical inner surface 228 having a longitudinal axis. A slot 230 having parallel side walls 232 extends radially outwardly from the inner surface 228 and terminates in a tapered arcuate surface 234. A plurality of integral teeth 236 project radially outwardly from the central body portion 222 and extend at an angle of about 45 degrees relative to the longitudinal axis thereof and are located to mesh with and be driven by the teeth 190 of the driving gear 40. A plurality of spaced apart threaded openings 238 extend in an axial direction into the central body portion 222.

Figure 22:
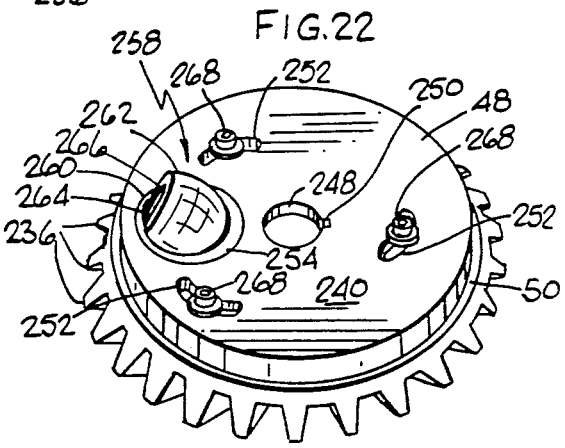
FIG. 22 is a perspective view of FIGS. 20 and 21 in an assembled relationship.
Figure 23:
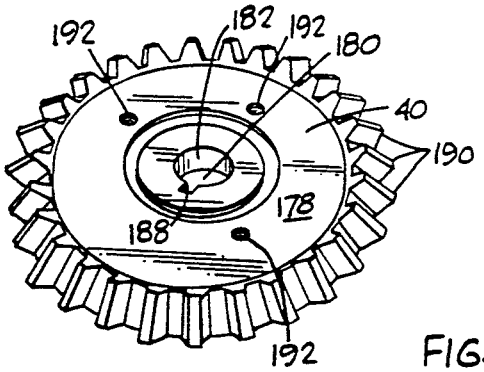
FIG. 23 is a perspective view of the driving gear or the third driven gear.
Figure 24:
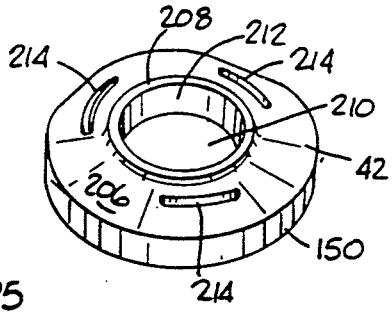
FIG. 24 is a perspective view of the cam for the redraw assembly.

The mounting member 48 has a generally planar upper surface 240, a generally planar lower surface 242 and a generally cylindrical outer surface 244 having a longitudinal axis. A central opening 246 is formed in the mounting member 48 and has a generally cylindrical inner surface 248 having a diameter slightly greater than the outer diameter of the shaft 46 so that the mounting member 48 may be positioned over the shaft 46. A keyway 250 extends radially outwardly from the generally cylindrical inner surface 248 and cooperates with a key 186 on the shaft 46, similar to the key 186 on the drive shaft 34, to provide for rotation of the mounting member 48. A plurality of spaced apart arcuately shaped slots 252 extend in an axial direction through the mounting member 48. An offset opening 254 extends through the mounting member 48 and has a generally cylindrical inner surface 256 having a longitudinal axis parallel to the longitudinal axis of the mounting member 48. As illustrated in FIG. 22, a universal bearing 258 has an outer member 260 fixedly mounted in the offset opening 254 and an inner member 262 having a spherical outer surface that mates with a spherical inner surface of the outer member so that the inner member is universally rotatable. A central bore 264 extends through the inner member 262 and has a generally cylindrical inner surface 266. As illustrated in FIG. 22, the first driven gear 50 and the mounting member 48 are assembled by first mounting the universal bearing 258 in the mounting member 48. The bottom surface 242 of the mounting member 48 is then placed on the upper surface 222 of the first driven gear 50 so that the universal bearing 258 is over the slot 230. A headed threaded bolt 268 is passed through each of the arcuately shaped slots 252 and is threaded into one of the threaded openings 238 so that the first driven gear 5Q is adjustably mounted on the mounting member 48. The arcuately shaped slots 252, the bolts 268 and the threaded openings 238 are designed so that when the bolts 268 are tightened to secure the first driven gear 50 firmly on the mounting member 48, the longitudinal axes of the central openings 226 and 246 coincide. The construction and mounting of the second driven gear 58 and the mounting member 56 are the same as the construction and mounting of the first driven gear 50 and the mounting member 48 described above.

Figure 26:
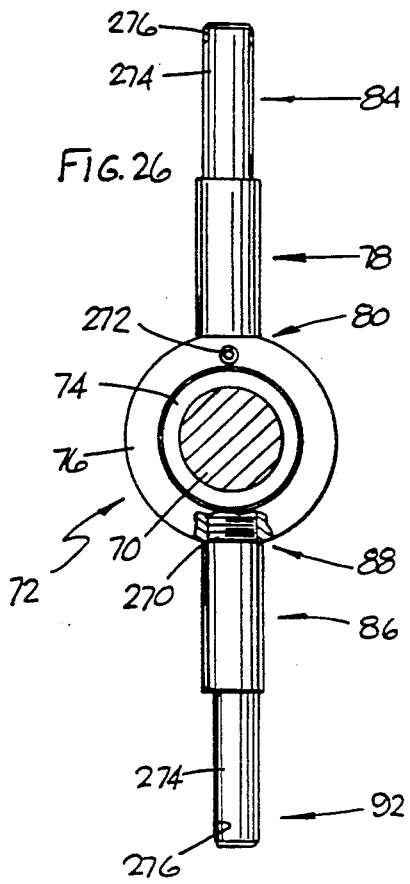
FIG. 26 is a front elevational view of the connecting means mounted on a bearing mounted on the ram.
Figure 27:
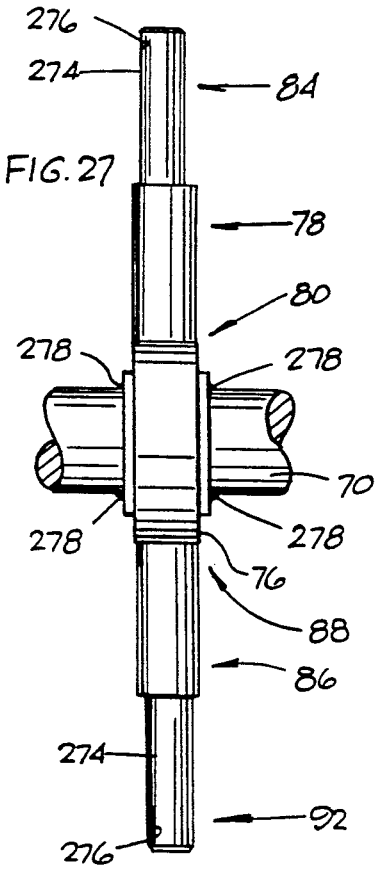
FIG. 27 is a side elevational view of FIG. 26.

The first and second connecting means 78 and 86 are illustrated in FIGS. 26 and 27 wherein the first end portions 80 and 88 thereof have threaded portions 270 threadedly engaged in the outer member 76 and secured by a set screw 272. The second end portions 84 and 92 comprise a rod 274 having a generally cylindrical outer surface 276 having a diameter substantially the same as but slightly less than the diameter of the generally cylindrical inner surface 266 so that the rod 274 may slide through the central opening 264 in the inner member 262. The inner member 74 is secured to the ram 70 by suitable means such as by welding 278.

Figure 28:
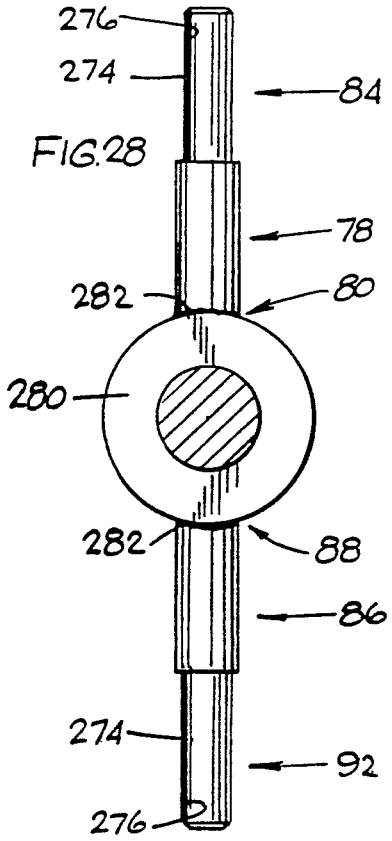
FIG. 28 is a front elevational view of the connecting means mounted on the ram.
Figure 29:
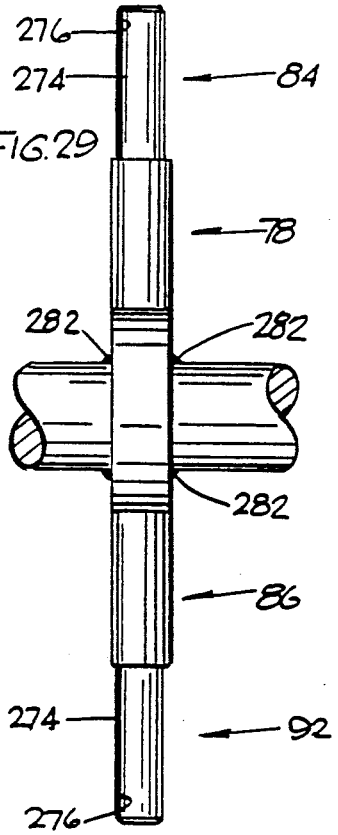
FIG. 29 is a side elevational view of FIG. 28.

A modification of the first and second connecting means 78 and 86 is illustrated in FIGS. 28 and 29. This modification is the same as that illustrated in FIGS. 26 and 27 except that the bearing 72 has been replaced by an annular member 280 that is secured to the ram 70 by suitable means such as by welding 282. When using the modification of FIGS. 28 and 29, the key 156 in the bushing 152 is omitted so that the ram 70 will rotate as it is reciprocated.

The operation of the apparatus is illustrated generally in FIGS. 15 and 16. In FIG. 15, the ram 70 is at the midpoint of its total distance of travel. The cam followers 146 and the peripheral camming surfaces have cooperated to position the first redraw assembly 24 in position against the first cam forming and ironing die means 22. The ram 70 is moving in the direction indicated by the arrow 284, the first driven gear 50 is moving in the direction of the arrow 286, the driving gear 40 is moving in the direction of the arrow 288 and the third driven gear 64 is moving in the direction of the arrow 290. The rod 274 projects slightly out of the inner member 262. The second redraw assembly 30 is in the retracted position for receiving a can blank. As the driving gear 40 rotates the first and second driven gears 50 and 58, the ram 70 is moved through the first redraw assembly 24 and into the first can forming and ironing die means 22. As the first and second gears 50 and 58 rotate, the rods 274 slide through the inner member 262 which rotates in the outer member 260. As illustrated in FIG. 16, the second driven gear 58 rotates in a direction opposite to the direction of rotation of the first driven gear 50 as indicated by the arrows 286 and 292. Therefore, the universal bearings 258 in these driven gears are directly opposite to each other so that the ram 70 has been moved through the first can forming and ironing die means 22. The rods 274 have been extended their greatest distance through the inner member 262. The cam followers 146 and the peripheral camming surfaces 150 have cooperated to move the first redraw assembly 24 to its retracted position to receive a can blank and the second redraw assembly 30 to a position against the second can forming and ironing die means 28. As the driving gear 40 continues to rotate the first and second driven gears 50 and 58, the ram 70 will be moved back toward the second redraw assembly 30 and then through the second can forming and ironing die means 28. The operational cycle will continue as long as the driving gear 40 is rotated. If desired, the shaft 62 driven by the rotation of the third driven gear 64 may be used to provide power for other operations.

While illustrative and presently preferred embodiments of the invention has been described in detail herein, it is to be understood that the inventive concepts may be otherwise variously embodied and employed and that the appended claims are intended to be construed to include such variations except insofar as limited by the prior art.

What is claimed is:

1. A method for moving a movable member comprising:

rotatably mounting a first member having an axis of rotation on support structure;

rotatably mounting a second member so that its axis of rotation is aligned with said axis of rotation of said first member on said support structure;

rotating said first and second members so that said second member rotates in a direction opposite to the direction of rotation of said first member;

slidably mounting a movable member on said support structure for reciprocating linear sliding movement; and connecting said first and second members to said movable member so that rotation of said first and second members reciprocates said movable member in said linear directions.

2. A method as in claim 1 and further comprising:

rotating said movable member during said reciprocation thereof.

* * * * *